US008312567B1

(12) United States Patent
Valle

(10) Patent No.: US 8,312,567 B1
(45) Date of Patent: Nov. 20, 2012

(54) WEIGHTED EXERCISE GLOVES

(76) Inventor: Antonio Valle, Houston, TX (US)

( * ) Notice: Subject to any disclaimer, the term of this patent is extended or adjusted under 35 U.S.C. 154(b) by 768 days.

(21) Appl. No.: 12/316,493

(22) Filed: Dec. 12, 2008

(51) Int. Cl.
*A41D 19/00* (2006.01)

(52) U.S. Cl. ..... 2/161.1

(58) Field of Classification Search ..... 2/16, 161.1, 2/161.2, 161.3, 158, 159, 161.4, 162, 163; 482/105
See application file for complete search history.

(56) References Cited

U.S. PATENT DOCUMENTS

| | | | | | |
|---|---|---|---|---|---|
| 4,247,097 | A | | 1/1981 | Schwartz | |
| 4,330,120 | A | * | 5/1982 | Netti | 482/105 |
| 4,556,215 | A | * | 12/1985 | Tarbox et al. | 482/105 |
| 4,575,075 | A | * | 3/1986 | Tarbox et al. | 482/105 |
| 4,684,123 | A | * | 8/1987 | Fabry | 482/105 |
| 4,911,433 | A | | 3/1990 | Walker et al. | |
| 4,923,418 | A | * | 5/1990 | Hoffman | 441/57 |
| 5,300,000 | A | | 4/1994 | Schwartz | |
| 5,453,064 | A | * | 9/1995 | Williams, Jr. | 2/161.1 |
| 5,468,200 | A | | 11/1995 | Hoffman | |
| 5,575,008 | A | | 11/1996 | McBride et al. | |
| 5,683,335 | A | | 11/1997 | Groves et al. | |
| D387,503 | S | | 12/1997 | Ho | |
| 5,768,710 | A | * | 6/1998 | Williams | 2/161.1 |
| 5,898,943 | A | * | 5/1999 | Kim | 2/161.2 |
| 6,119,267 | A | | 9/2000 | Pozzi | |
| 6,119,271 | A | * | 9/2000 | Byon | 2/161.2 |
| 6,279,163 | B1 | | 8/2001 | Hale et al. | |
| 6,553,574 | B1 | | 4/2003 | Hall, Jr. et al. | |
| 6,990,689 | B1 | | 1/2006 | Thellmann | |
| 7,856,670 | B1 | * | 12/2010 | Hazuga et al. | 2/160 |
| 2002/0128120 | A1 | | 9/2002 | Cook | |

* cited by examiner

*Primary Examiner* — Danny Worrell
(74) *Attorney, Agent, or Firm* — Montgomery Patent & Design, LLC; Robert C. Montgomery; Joseph Yaksich

(57) ABSTRACT

An athletic glove with an integral weight system is herein disclosed, comprising a plurality of pockets on the back of the glove which holds either sand or metal shot to add weight. The amount of weight will vary per glove model, but is envisioned to be approximately three (3) to five (5) pounds per glove, depending on user preference. The glove is secured around a wrist during use by a hook-and-loop fastener. The glove with the integral weight system is intended to strengthen the hand, arm and upper body areas during work-outs, exercise or everyday activities. The glove is expected to be introduced in both right-hand and left-hand configurations and to be presented as a pair.

13 Claims, 3 Drawing Sheets

WEIGHTED EXERCISE GLOVES

RELATED APPLICATIONS

The present invention was first described in a notarized Official Record of Invention on Jun. 22, 2007, that is on file at the offices of Montgomery Patent and Design, LLC, the entire disclosures of which are incorporated herein by reference.

FIELD OF THE INVENTION

The present invention relates generally to a weighted exercise glove and, more particularly, to said glove comprising a plurality of weighted enclosures thereon a backhand side and a weighted fist grip thereon a palm side which provide additional resistance to arm and shoulder conditioning training while leaving the hands free for use.

BACKGROUND OF THE INVENTION

One of the common sights during a baseball game is that of the oncoming batter swinging a bat around with donut-shaped weights on it. This practice not only helps condition and loosens muscles before batting; it also gives the illusion of a lighter bat when the weights are removed. Thus when the batter does bat, hopefully he or she will be able to swing the bat quicker and more precisely due to its perceived weight decrease. This practice and technique is useful for any physical conditioning activity but requires the user to physically hold the weight in their hands. This obviously does not allow the use of the hands for other activities and therefore does not find widespread use due to the amount of dedicated time it requires. Accordingly, there exists a need for a means by which hands, arms and upper body areas can be strengthened and toned by the strategic placement of weights that do not require a dedicated effort to use by the wearer. The development of the invention herein disclosed fulfills this need.

The present invention is a pair of athletic gloves with an integral weight system. The glove is equipped with a plurality of pockets on the back of the glove which holds either sand or metal shot and a tubular shaped fist grip for an additional weight. The amount of weight will vary per model of glove, but is envisioned to be approximately three (3), four (4), or five (5) pounds per glove, dependent on user preference. The gloves are secured during use by a strap system around the wrist with uses hook-and-loop fastener such as Velcro®. The invention is intended to strengthen the hand, arm and upper body area during workouts, exercise, or just plain everyday activities. The use of the present invention allows users the ability to strengthen their hand and upper body area in a quick, easy and effective manner so that increased dexterity and speed can be realized during other sporting activities.

Several attempts have been made in the past to provide weighted exercise training gloves. U.S. Pat. No. 4,247,097, issued in the name of Schwartz, describes a variable weight aerobic exercise glove. The glove comprises a single mitten type enclosure of the fingers, a palm enclosure, and two pockets on the backhand side of the glove which allow for various interchangeable weight plates to be inserted. However, unlike the present invention, the Schwartz glove does not allow for optimum mobility or use of the hands while worn and the inserted weights are likely to fall out during intense workouts.

U.S. Pat. No. 4,911,433, issued in the name of Walker et al., describes a weighted athletic glove comprising a plurality of tiny weights attached to the backhand side of a glove body. However, unlike the present invention, the Walker glove has a limited weight capacity and the plurality of small weights is unsuitable for boxing or other sparring type activities.

U.S. Pat. No. 5,468,200, issues in the name of Hoffman describes a weighted exercise glove having webbed fingers. The Hoffman glove comprises a glove body with a pocket on the backhand side thereof in which a weight is inserted, two (2) straps which wrap around the hand and the weight to secure the weight, and webbed finger connections. However, unlike the present invention, the Hoffman glove is intended for adding weight resistance while swimming and the inserted weights are likely to fall out during intense workouts.

U.S. Pat. No. 5,575,008 issued in the name of McBride et al., discloses a martial arts training glove comprising a padded training glove intended to provide protection to the hand of a wearer when striking an object. The McBride glove comprises enclosures thereon the backhand side of the glove which are filled with granular material to protect outer portions of the hand during common martial arts strikes. However, unlike the present invention, the McBride glove lacks a means to equally distribute the granular material within the enclosure making it likely that said material will collect near a bottom portion of the enclosure.

U.S. Pat. No. 6,553,574 issued in the name of Hall et al., discloses a weighted therapeutic glove comprising a pockets on the backhand side and palm side of the glove intended for removably receiving insertable weights. However, unlike the present invention, the Hall glove is unsuitable for vigorous exercise or sparring type training where the weighted material needs to be securely attached to the glove.

U.S. Pat. No. 6,990,689 issued in the name of Thellmann, discloses a weighted soccer goalie glove comprising an ordinarily shaped soccer goalie's glove with particular enhancements such as additional weight and a ball gripping surface. The additional weights are removably inserted into pockets located on the backhand portion of the glove. However, unlike the present invention, the Thellmann glove is intended for improving the strength and agility of a soccer goalie and is not suitable for a sparring or a fight type training routines.

Additionally, ornamental designs for weighted exercise gloves provided, particularly, U.S. Pat. No. D 387,503. However, none of these designs are similar to the present invention.

The prior art appears to disclose various weighted exercise training gloves. However, none of the prior art particularly describes a weighted exercise glove comprising a plurality of weighted enclosures thereon a backhand side and a weighted fist grip thereon a palm side which provide additional resistance to arm and shoulder conditioning training while leaving the hands free for use that the instant invention possesses. Accordingly, there exists a need for a means by which hands, arms and upper body areas can be strengthened and toned by the strategic placement of weights that do not require a dedicated effort to use by the wearer that operates without the disadvantages as described above.

SUMMARY OF THE INVENTION

In view of the foregoing disadvantages inherent in the prior art, it has been observed that there is need for a weighted exercise glove comprising a plurality of weighted enclosures which distribute the weight evenly and a weighted fist grip which provides additional fist stability while performing condition training or other activity.

To achieve the above objectives, it is an object of the present invention to provide a weighted exercise glove comprising a glove body, a backhand enclosure, a knuckle enclosure, four (4) finger enclosures, and a fist grip.

A further object of the present invention is to have a glove body comprising a backhand side, a palm side, and five (5) finger portions and providing a means of covering the hand of a wearer and an attachment surface to the plurality of enclosures and fist grip.

Yet still another object of the present invention if to have a glove body comprising a wrist opening located at the lower end of the glove body through which the hand of a wearer is inserted.

Yet still another object of the present invention is to have five (5) elongated finger portions which extend outward from the upper portion of the glove body with each comprising a digit aperture on a truncated distal end through which the end of the finger will protrude when the glove is worn.

Yet still another object of the present invention is to have a wrist strap located on the lower portion of the glove body which provides a means of tightening the weighted glove around the wrist of a wearer.

Yet another object of the present invention is to have a wrist strap which provides a means of removably connecting two (2) communicating sides of a hook-and-loop fastener.

Yet still another object of the present invention is to have a backhand enclosure located on a first rear outside surface of the backhand side of the glove body wherein the area between provides a means of containing weighted material.

Yet still another object of the present invention is to have a knuckle enclosure located on the first rear outside surface of the backhand side of the glove body at a first knuckle surface wherein the area between provides a means of containing weighted material.

Yet still another object of the present invention is to have four (4) finger enclosures located on the first rear surface of the backhand side of the glove body at a second knuckle surface wherein the area between provides a means of containing weighted material.

Yet still another object of the present invention is to have a weighted material comprising an amount of granulated metal or sand.

Yet still another object of the present invention is to have a backhand enclosure comprising an internally-stitched grid pattern which provides a means for maintaining and uniformly distributing the weighted material.

Yet still another object of the present invention is to have a knuckle enclosure comprising an internally-stitched grid pattern which provides a means for maintaining and uniformly distributing the weighted material.

Yet still another object of the present invention is to have fist grip which is attached to the second rear outside surface of the palm side of the glove body comprising a weighted member and a fist grip pad.

Yet still another object of the present invention is to have a fist grip pad which provides a means of enclosing and attaching the weighted member to the second rear outside surface of the glove body.

Yet still another object of the present invention is to have a fist grip which provides a means for additional weight and improved grip and control of the weighted glove when worn.

Yet still another object of the present invention is to have a weighted member comprising a cylindrical steel member.

Yet still another object of the present invention is to have a weighted glove made of leather, vinyl, or nylon.

Yet still another object of the present invention is to have a weighted glove which is available in both a left hand and a right hand embodiment.

Yet still another object of the present invention is to have a weighted glove which provides a means for strengthening the hands, arms, and upper body of a wearer during exercise and other activities.

Yet still another object of the present invention is to have a weighted glove comprising various weights of the weighted member and various amounts of weighted material such that the total weight of the glove may vary.

Yet still another object of the present invention is providing a method for utilizing a weighted exercise glove.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
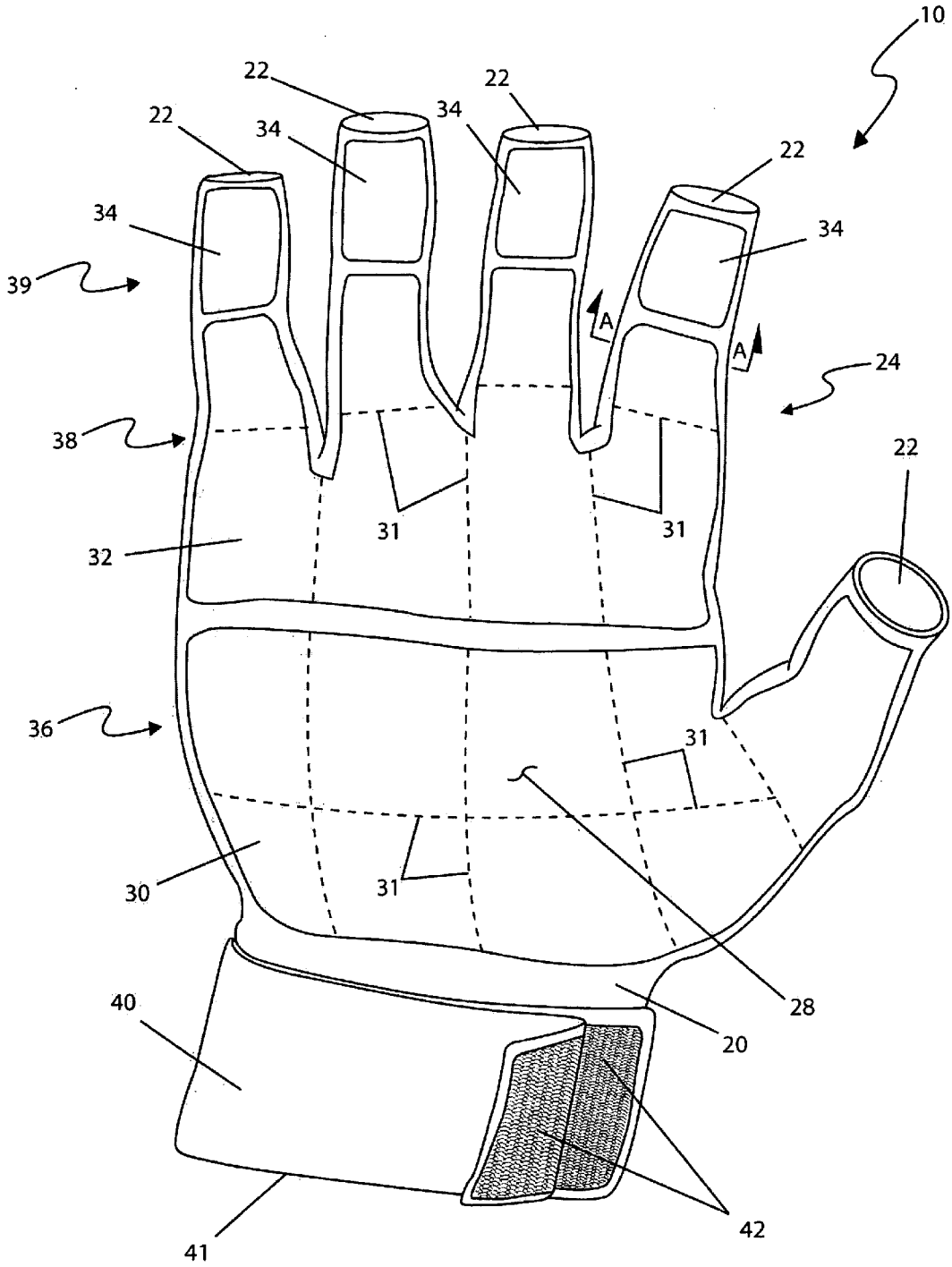
FIG. 1 is a rear perspective view of a weighted exercise glove 10, depicting the backhand side according to a preferred embodiment of the present invention.

10 weighted exercise glove
20 glove body
22 digit aperture
24 backhand side
26 palm side
28 first rear outside surface
29 second rear outside surface
30 backhand enclosure
31 grid pattern
32 knuckle enclosure
34 finger enclosure
36 backhand surface
38 first knuckle surface
39 second knuckle surface
40 wrist strap
41 wrist opening
42 hook-and-loop fastener
50 fist grip
52 fist grip pad
60 stitching
62 weighted material

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a weighted exercise glove (herein described as the "device") 10, which provides a means for strengthening the hand, arm, and upper body areas during exercise activities. The device 10 comprises an athletic glove body 20 with an integral weight system comprising a plurality of inner reservoirs on the back side of said glove body 20 which hold a predetermined amount of weighted material 62 depending on the model. The device 10 is expected to be introduced as a pair comprising both a right-hand and a left-hand configuration and be offered in a variety of weights and sizes.

Referring now to FIG. 1, a rear perspective view of the device 10 depicting the back hand side, according to the preferred embodiment of the present invention, is disclosed. The device 10 comprises a glove body 20 preferably made of a durable textile or other material such as leather, vinyl, nylon or the like. The glove body 20 comprises features common to other conventional exercise and fighting gloves such as a backhand side 24, a palm side 26, five (5) digit openings, a wrist opening 41, padding, and the like with truncated finger portions which allow each finger of a user to protrude therethrough a digit aperture 22. The glove body 20 further comprises a backhand side 24 which further comprises a first rear outside surface 28, a backhand surface 36, a first knuckle surface 38, and a second knuckle surface 39. The first rear outside surface 28 comprises the glove body and covers the backhand portion and lower finger portions of the hand. The backhand surface 36 located thereon a lower portion of the first rear outside surface 28 comprises a backhand enclosure 30. The first knuckle surface 38 located thereon a middle portion of the first rear outside surface comprises a knuckle enclosure 32. The second knuckle surface 39 located thereon an upper portion of the first rear outside surface comprises four (4) finger enclosures 34. The backhand enclosure 30, the knuckle enclosure 32, and the four (4) finger enclosures 34 are preferably made of a durable material such as leather, vinyl, or the like and which provide a reservoir means for an integral weight system for said device 10 (see FIG. 3). The backhand enclosure 30 is envisioned comprising an internally-stitched grid pattern 31 which provides a means for the uniform distribution of an internal weighted material 62 and is located on an outside surface of the backhand and thumb portion of the glove body 20. The knuckle enclosure 32 is envisioned comprising an internally-stitched grid pattern 31 and is located on an outside surface of the knuckle portion of the glove body 20. The finger enclosure 34 is located on a back outside surface of a second knuckle section of each finger. The device 10 further comprises a wrist strap 40 preferably made of a flexible durable material which provides a means for said device 10 to be tightened thereto the wrist of a user and as a wrist stabilizer and support member. The wrist strap 40 is envisioned to wrap therearound the wrist of a user and be secured via cooperation between two (2) opposing sides of a hook-and-loop fastener 42.

Figure 2:
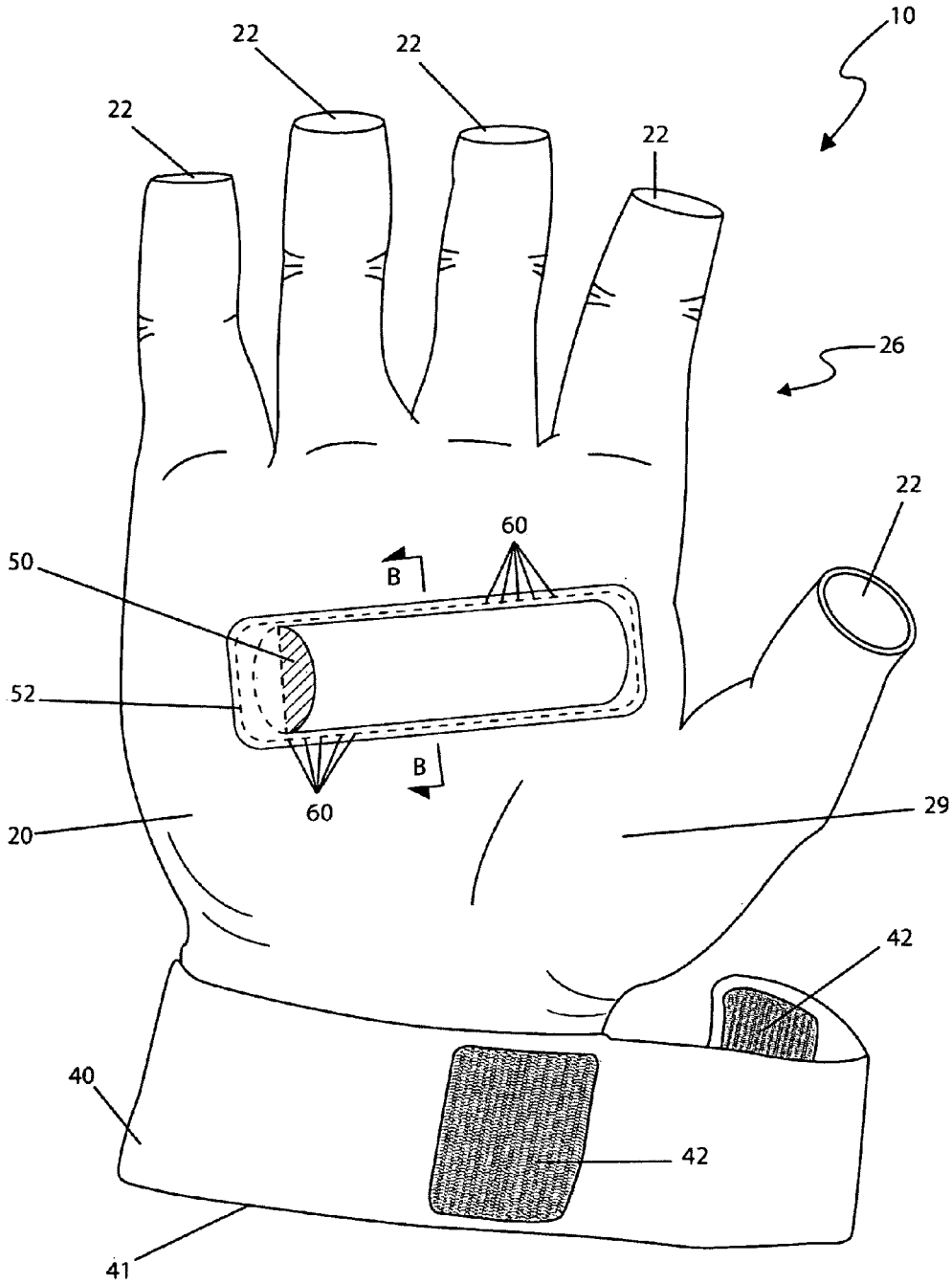
FIG. 2 is a front perspective view of a weighted exercise glove 10, depicting the palm side according to a preferred embodiment of the present invention.

Referring now to FIG. 2, a front perspective view of the device 10 depicting the palm side, according to the preferred embodiment of the present invention, is disclosed. The palm side 26 of the device 10 comprises a fist grip 50 which further comprises a cylindrical member, preferably a weighted metal such as steel which provides additional weight and a means for improved grip and control when using said device 10. The fist grip 50 is located thereon a second rear outside surface 29 thereunder and parallel to the base of the proximal end of the fingers and is enclosed therewithin a fist grip pad 52. The fist grip pad 52 provides a means of attaching said fist grip thereto the glove body 20.

Figure 3:
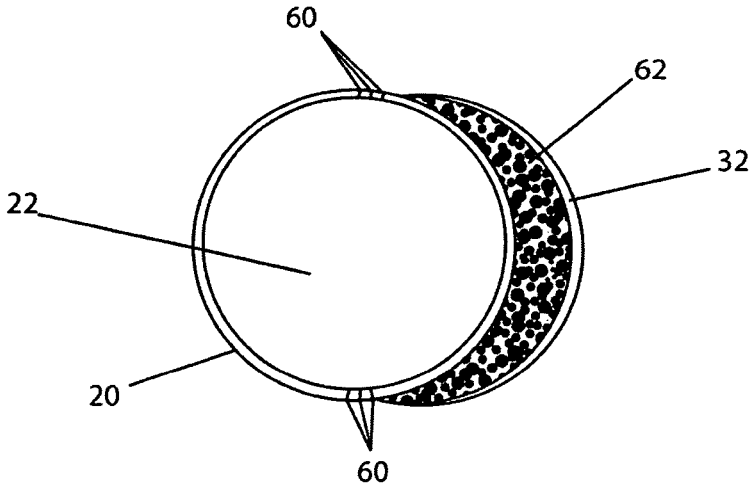
FIG. 3 is a section view of a finger portion of a weighted exercise glove 10 taken along section line A-A (see FIG. 1), according to a preferred embodiment of the present invention; and, FIG. 4 is section view taken along section line B-B (see FIG. 2), according to a preferred embodiment of the present invention.

Referring now to FIG. 3, a section view of a finger portion of the device 10 taken along section line A-A (see FIG. 1), according to the preferred embodiment of the present invention, is disclosed. This view illustrates the relationship therebetween the glove body 20 and the finger enclosure 34 which provide a containing means for an amount of weighted material 62 enclosed therewithin. The weighted material 62 is envisioned as an amount of granulated weighted material such as metal, sand, or the like. The finger enclosure 34 attaches thereto the glove body 20 via common textile manufacturing techniques such as adhesion and multi-thickness stitching. The backhand enclosure 30 and knuckle enclosure 32 provide a similar function and attach by a similar means thereto the glove body 20 as the finger enclosure 34.

Figure 4:
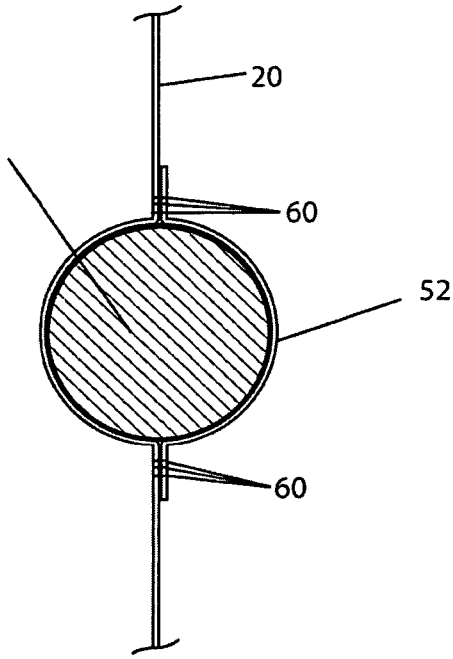

Referring now to FIG. 4, a section view taken along section line B-B (see FIG. 2) according to the preferred embodiment of the present invention, is disclosed. This view illustrates the relationship therebetween the glove body 20 and the fist grip pad 52 which provide a containing means for the fist grip 50 enclosed therewithin. The fist grip 50 is bisected on a centerline with one half (½) below and one half (½) above the contact surface of the fist grip pad 52 and the glove body 20. The fist grip pad 52 comprises a section of preferably durable material and is envisioned as attaching thereto the glove body 20 through adhesives and durable stitching 60.

The device 10 is envisioned to be introduced in both a left hand and a right hand embodiment. The device 10 is also envisioned to be introduced in variably weighted embodiments by controlling the type and amount of weighted material 62 therein the enclosures 30, 32, 34.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: retrieving either a left hand or a right hand embodiment or both in a desired weight and size of the device 10; placing the left hand embodiment thereon the left hand of the user by inserting said left hand therein the wrist opening 41 thereof the glove body 20 allowing the fingers of the user to protrude therethrough the digit apertures 22; tightening the device 10 by wrapping the wrist strap 40 therearound the left wrist of the user; engaging the two (2) cooperative ends of the hook-and-loop fastener 42; placing the right hand embodiment thereon the right hand of the user by inserting said right hand therein the wrist opening thereof the glove body 20 allowing the fingers of the user to protrude therethrough the digit apertures 22; tightening the device 10 by wrapping the wrist strap 40 therearound the right wrist of the user; engaging the two (2) cooperative ends of the hook-and-loop fastener 42; enclosing the fingers on each hand therearound the fist grip 50; exercising as normal through shadow boxing, bag work, or the like; and, benefiting from increased and improved strength, speed, and stamina afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An exercise glove, comprising:

a glove body for covering a hand comprising a backhand side, a palm side opposite said backhand side, and a plurality of elongated finger portions extending outwardly from a top portion of said glove body;

each of said plurality of elongated finger portions comprising a digit aperture located at a top end;

a wrist opening located at a bottom portion of said glove body, thereby allowing a user to insert said hand therein said glove;

a wrist strap located at said bottom portion of said glove body, thereby providing a means for said glove to be tightened thereto a wrist of said user;

a backhand enclosure located on a first rear outside surface of said backhand side at a backhand surface;

a knuckle enclosure located on said first rear outside surface of said backhand side at a knuckle surface;

a finger enclosure located on said first rear outside surface of said backhand side at a second knuckle surface;

a fist grip pad attached to said glove body on a second rear outside surface of said palm side; and a fist grip comprising a weighted member completely enclosed within said fist grip pad;

wherein said digit apertures allow each finger of said user to protrude therethrough;

wherein said fist grip provides additional weight and improved grip and control of said glove;

wherein an area between said glove body and said knuckle enclosure and said glove body and said finger enclosure provides a containing means for a weighted material; and, wherein said glove provides a means for strengthening said hand, an arm, and an upper body of said user during exercising activities.

2. The glove of claim 1, wherein said weighted material is an amount of granulated metal or sand.

3. The glove of claim 1, wherein said weighted member is steel.

4. The glove of claim 1, wherein said weighted material and said weighted member is available in a variety of amounts.

5. The glove of claim 1, wherein said backhand enclosure comprises an internally-stitched grid pattern for providing a means for uniform distribution of said weighted material and said weighted member.

6. The glove of claim 1, wherein said knuckle enclosure comprises an internally-stitched grid pattern for providing a means for uniform distribution of said weighted material and said weighted member.

7. The glove of claim 1, wherein said finger enclosure comprises an internally-stitched grid pattern for providing a means for uniform distribution of said weighted material and said weighted member.

8. The glove of claim 1, wherein said wrist strap is secured by removably connecting two (2) opposing sides of a hook-and-loop fastener.

9. The glove of claim 1, wherein each of said plurality of elongated finger portions are truncated.

10. The glove of claim 1, wherein said glove body is made of leather, vinyl, or nylon.

11. The glove of claim 1, wherein said plurality of elongated finger portions are made of leather, vinyl, or nylon.

12. The glove of claim 1, wherein said glove is made available in both a left hand and a right hand embodiment.

13. A method for using an exercise glove, said method comprising the steps of:

providing said glove, comprising:

a glove body for covering a hand comprising a backhand side, a palm side opposite said backhand side, and a plurality of elongated finger portions extending outwardly from a top portion of said glove body;

each of said plurality of elongated finger portions comprising a digit aperture located at a top end;

a wrist opening located at a bottom portion of said glove body, thereby allowing a user to insert said hand therein said glove;

a wrist strap located at said bottom portion of said glove body, thereby providing a means for said glove to be tightened thereto a wrist of said user;

a backhand enclosure located on a first rear outside surface of said backhand side at a backhand surface;

a knuckle enclosure located on said first rear outside surface of said backhand side at a first knuckle surface;

a finger enclosure located on said first rear outside surface of said backhand side at a second knuckle surface; and, a fist grip pad attached to said glove body on a second rear outside surface of said palm side; and a fist grip comprising a weighted member completely enclosed within said fist grip pad;

wherein said digit apertures allow each finger of said user to protrude therethrough;

wherein said fist grip provides additional weight and improved grip and control of said glove;

wherein an area between said glove body and said knuckle enclosure and said glove body and said finger enclosure provides a containing means for a weighted material; and, wherein said glove provides a means for strengthening said hand, an arm, and an upper body of said user during exercising activities;

retrieving either a left hand embodiment or a right hand embodiment or both in a desired weight and size of said glove;

placing said left hand embodiment thereon a left hand of said user by inserting said left hand therein said wrist opening of said glove body allowing a plurality of fingers of said user to protrude therethrough said digit apertures;

tightening said glove by wrapping said wrist strap therearound a left wrist of said user;

engaging a first cooperative end and a second cooperative end of a hook-and-loop fastener;

placing said right hand embodiment thereon a right hand of said user by inserting said right hand therein said writing opening of said glove body allowing said plurality of finger of said user to protrude therethrough said digit apertures;

tightening said glove by wrapping said wrist strap therearound a right wrist of said user;

engaging said first cooperative end and said second cooperative end of said hook-and-loop fastener;

enclosing said plurality of fingers on each hand therearound said fist grip; and commencing exercising activities.

* * * * *